US010584487B2

(12) United States Patent
Caboni

(10) Patent No.: US 10,584,487 B2
(45) Date of Patent: Mar. 10, 2020

(54) MODULAR SYSTEM FOR ASSEMBLING A TRANSPIRING, DISPOSABLE HEAT-INSULATION SHUTTERING MOULD / FORMWORK USED FOR SURFACE CASTING

(75) Inventor: Michele Caboni, Oristano (IT)

(73) Assignee: Michele Caboni, Oristano (IT)

( * ) Notice: Subject to any disclaimer, the term of this patent is extended or adjusted under 35 U.S.C. 154(b) by 0 days.

(21) Appl. No.: 13/979,563

(22) PCT Filed: Jan. 10, 2012

(86) PCT No.: PCT/IT2012/000004
§ 371 (c)(1),
(2), (4) Date: Jul. 12, 2013

(87) PCT Pub. No.: WO2012/095881
PCT Pub. Date: Jul. 19, 2012

(65) Prior Publication Data

US 2013/0284881 A1 Oct. 31, 2013

(30) Foreign Application Priority Data

Jan. 13, 2011 (IT) ..... TO2011A0013

(51) Int. Cl.

| | |
|---|---|
| ***E04B 5/19*** | (2006.01) |
| ***E04B 5/36*** | (2006.01) |
| ***E04F 15/12*** | (2006.01) |
| ***E04B 5/21*** | (2006.01) |
| ***E04C 5/16*** | (2006.01) |
| ***E04C 5/20*** | (2006.01) |
| ***E04B 5/38*** | (2006.01) |

(52) U.S. Cl.
CPC ..... *E04B 5/19* (2013.01); *E04B 5/21* (2013.01); *E04B 5/36* (2013.01); *E04B 5/38* (2013.01); *E04C 5/168* (2013.01); *E04C 5/20* (2013.01); *E04F 15/123* (2013.01); *Y10T 29/49826* (2015.01)

(58) Field of Classification Search
CPC ..... E04B 5/19; E04B 5/38; E04B 5/36; E04C 5/20; E04F 15/123
USPC ..... 52/220.1, 220.3, 319, 320, 323, 337; 248/346.01, 188
See application file for complete search history.

(56) References Cited

U.S. PATENT DOCUMENTS

| | | | |
|---|---|---|---|
| 3,151,391 | A | 10/1964 | Ollier |
| 4,136,798 | A | 1/1979 | Oberstein |
| 4,472,331 | A | 9/1984 | Kida |

(Continued)

FOREIGN PATENT DOCUMENTS

| | | |
|---|---|---|
| CA | 2264099 | 2/1998 |
| CH | 367966 | 3/1963 |

(Continued)

OTHER PUBLICATIONS

International Search Report for PCT/IT2012/000004, Completed by the European Patent Office dated Jun. 22, 2012, 3 Pages.

*Primary Examiner* — Michael Safavi

(57) ABSTRACT

A system for assembling a transpiring, "disposable" heat-insulation shuttering mould and/or formwork used to cast a concrete surface, which includes at least one supporting plane featuring one upper surface on which a plurality of supports are arranged, which are suited to accommodate and retain (at least sideways inside themselves) at least one longitudinal or reticular portion of a tubular element.

30 Claims, 12 Drawing Sheets

(56) References Cited

U.S. PATENT DOCUMENTS

| | | | |
|---|---|---|---|
| 4,731,968 | A | 3/1988 | Obino |
| 4,833,857 | A | 5/1989 | Wheeler |
| 5,383,319 | A | 1/1995 | Sorqvist |
| 5,428,933 | A | 7/1995 | Philippe |
| 6,370,831 | B1 | 4/2002 | Marshall et al. |
| 7,082,732 | B2 | 8/2006 | Titishov |
| 8,181,414 | B2 | 5/2012 | Garrett |
| 2004/0103609 | A1 | 6/2004 | Wostal et al. |
| 2005/0028466 | A1 | 2/2005 | Titishov |
| 2007/0214740 | A1 | 9/2007 | O'Grady |
| 2008/0172972 | A1 | 7/2008 | Williams |
| 2009/0044481 | A1 | 2/2009 | Turek |
| 2010/0065716 | A1 | 3/2010 | Amend |

FOREIGN PATENT DOCUMENTS

| | | |
|---|---|---|
| DE | 2013630 | 11/1971 |
| DE | 3410484 | 10/1985 |
| DE | 9418036 | 1/1995 |
| DE | 4332115 | 3/1995 |
| DE | 29611835 | 11/1996 |
| DE | 102008050741 | 4/2010 |
| EP | 0137105 | 4/1985 |
| EP | 0163117 | 12/1985 |
| EP | 0368804 | 5/1990 |
| EP | 0803618 | 10/1997 |
| EP | 1092816 | 4/2001 |
| EP | 1605113 | 12/2005 |
| FR | 663193 | 8/1929 |
| FR | 2328814 | 5/1977 |
| FR | 2813903 | 3/2002 |
| FR | 2874950 | 3/2006 |
| JP | 2002348858 | 12/2002 |
| WO | 9119055 | 12/1991 |
| WO | 03046310 | 6/2003 |
| WO | 2005014948 | 2/2005 |
| WO | 2005035898 | 4/2005 |
| WO | 2005061804 | 7/2005 |
| WO | 2006063140 | 6/2006 |
| WO | 2006081678 | 8/2006 |
| WO | 2008098686 | 8/2008 |

MODULAR SYSTEM FOR ASSEMBLING A TRANSPIRING, DISPOSABLE HEAT-INSULATION SHUTTERING MOULD / FORMWORK USED FOR SURFACE CASTING

CROSS-REFERENCE TO RELATED APPLICATION

This application is the U.S. national phase of PCT Application No. PCT/IT2012/000004 filed on Jan. 10, 2012, which claims priority to Italian Patent Application No. TO2011A000013 filed on Jan. 13, 2011, the disclosures of which are incorporated in their entirety by reference herein.

This invention pertains to a modular system for assembling a disposable shuttering mould used to cast a concrete surface, especially with regard to casting unidirectional, bi-directional, transpiring, ventilated and heat-insulation lofts, as well as monolith unidirectional and bi-directional, transpiring, ventilated and heat-insulation floors, and also unidirectional and bi-directional, transpiring, ventilated and heat-insulation slabs.

Such surfaces as lofts, floors or slabs are conventionally built, in the construction trade, by making use of ordinary materials, e.g. hollow flat blocks and hollow floor bricks made of tiles and/or built on a lightweight aggregates concrete base, combined with supporting structures such as, for instance, brick dwarf walls and pre-compressed joists. However, the building of these structures involve very high costs; moreover, it requires a long construction time and also involves making use of a large amount of materials that are, unfortunately, not homogeneous to one another and, above all, transmit moisture and also feature poor technical performance, the latter element being essential to be able to build structures complying with the increasingly stricter energy-saving standards worldwide. Furthermore, the structures of this kind will not make it possible to immediately make the coating concrete cast, since a wait time will be needed in order to wait for the consolidation of the brickwork structures themselves with the attached cross-pieces with very short centre distances for supporting the horizontal partition, i.e. the surface that requires the additional reinforced concrete cast. To remedy these problems in the course of time, the engineering techniques have proposed modular structures made of "disposable" formwork made from recycled plastics (referred to as "second life" formwork), which will guarantee simple, quick laying and also make it possible to cast the concrete soon after the formwork laying. These formworks will, after they are put together, define at the top a substantially uninterrupted plane that will form the base for the concrete casting: likewise, it is commonly known that the coating concrete layer is reinforced, in a large number of applications, by means of a reinforcing metal structure made up of a conventional electrowelded mesh and/or metal rods, in order to achieve the surface consolidation, such a reinforcing metal structure being laid on the place defined by the "disposable" plastic formworks and subsequently incorporated into the coating concrete casting, yet without guaranteeing the right distance of the electrowelded mesh itself to obtain an adequate bar cover as laid down by the Technical Construction Standards.

The requirement (defined as the conservation of the physical and mechanical features both of the materials and the structures) is an essential condition in order for the safety levels to be guaranteed during the entire works design service life.

In particular, as far as a reinforced concrete structure is concerned (e.g. a horizontal plane or partition), greatest importance should be attached, for the durability purposes, to the protection of metal reinforcements against corrosion.

For this reason, the following conditions should be met:

sufficient bar covering shall be made by making use of compact, high-quality, low-porosity and low-permeability concrete;

never exceed a crack limit state, which shall be commensurate to the environment conditions, the stress and the reinforcements' proneness to corrosion.

The need to provide an adequate bar cover is, in turn, essentially related to a number of significant reasons that involve several issues:

1) structural durability (as regards the reinforced concrete) guaranteed by adequate protection of reinforcement against oxidation—an essential condition to the proper stress transfer from steel to concrete, and vice versa;

2) concrete is able, due to its featuring a pH value of 12.5 to 13.5 (i.e. a basic one), to guarantee the reinforcement passivation, provided that the same is adequately protected;

3) the latter condition may, however, be altered by two different types of attack capable of nullifying the protection and triggering the corrosion, i.e. carbonation and chlorination. The spread of both of these phenomena into the concrete, as deep as the layer in which the reinforcement is placed, can be hampered by the very inclusion of an adequate concrete layer (that is to say, the bar cover itself);

4) appropriate fire resistance can be achieved also by adding some more non-structural covering layers (cf. UNI EN 1992-1-2).

In fact—and in particular—these structures pose a problem whereby, in case conventional rods are used to build the metal reinforcement, such rods cannot be secured firmly to the formwork and, therefore, will normally be secured to one another by carrying out conventional operations (i.e. tying by means of metal wires), in order to prevent them from being displaced off their original position during the completion cast (when the concrete is laid). All of this will give rise to problems in the correct use of the conventional "disposable" shuttering moulds/formwork made of recycled plastics.

Furthermore, the known modular systems of "disposable" shuttering moulds/formwork made of recycled plastics still pose serious transpiration problems, which may lead to building poorly efficient reinforced concrete structures (considering the remarks made above), indeed as far as civil buildings are concerned, which will give rise to the well-known causes of SBS (Sick Building Syndrome).

The aim of this invention is, therefore, to solve the above-mentioned problems intrinsic to the older technique, by providing a unique modular system for assembling a transpiring, "disposable" heat-insulation shuttering mould/formwork to protect the structural reinforcements, after casting a reinforced concrete surface that will make it possible both to easily and quickly lay the modular elements making up such transpiring, "disposable" heat-insulation and variable-geometry shuttering mould/formwork, and to easily and accurate position the elements acting as reinforcements for the coating concrete layer as well as the water, gas or electricity piping.

Another aim of this invention is to provide a fully modular system for assembling a transpiring, "disposable" heat-insulation and variable-geometry shuttering mould/formwork for casting a reinforced concrete surface, which will facilitate the laying and mutual hooking operations in a specular way among the various modular elements making up such heat-insulation construction system by building a solid structure, which will indeed be a transpiring and highly stable (from the structural viewpoint) monolith construction both during the additional casting phase (while guaranteeing the foot traffic thereon, with resulting worker safety) and during the entire service life of the construction, thanks to the adequate reinforcement bar covering.

Moreover, one further aim of this invention is to provide a fully modular system for assembling a transpiring, "disposable" heat-insulation shuttering mould/formwork for casting a reinforced concrete plane made up of dynamic constructions elements able to be assembled according to several configurations (even the most disparate ones).

The above and the other aims and advantages of the invention, as detailed in the description hereafter, will be obtained by means of a unique modular system for assembling a "disposable" shuttering mould/formwork for casting a reinforced concrete plane and, in particular, for casting unidirectional, bi-directional, transpiring, ventilated and heat-insulation lofts, as well as monolith unidirectional and bi-directional, transpiring, ventilated and heat-insulation floors, and also unidirectional and bi-directional, transpiring, ventilated and heat-insulation slabs, like the one described under claim 1. Preferred embodiment designs and original variants of this invention will be the object of the relevant claims.

It is obvious that a number of variants and modifications can be made to the described items (e.g. variants and modifications concerning the shape and dimensions, as well as the arrangements and the parts performing equivalent functions) without departing from the scope of protection of the invention, as referred to in the enclosed claims.

This invention will be best described by a few preferred forms of construction, which will be provided by way of example and with no limitation thereto, with reference to the enclosed drawings, where:

The description below will illustrate the unique features of the various elements making up the transpiring, heat-insulation modular system 1 in accordance with the present invention, by showing, in particular, a few possible assembling configurations for building shuttering moulds and formworks for which structural, transpiration and heat-insulation specifications shall be met: it is obvious to any one engineer expert in this field that these configurations are, due to the present invention being relative to a unique transpiring heat-insulation modular system, to be meant only as mere examples which somehow limit the nearly infinite possibilities of possible, different further configurations that the modular elements (which will be described hereafter) of the transpiring heat-insulation construction system referred to in this invention may feature depending on the required heat resistance, i.e. with reference to transmittance (it is expressed by U- and defines an element's insulating capacity, as well as by SL units) (cf. UNI EN ISO 6946), which can be measured as follows:

$$\frac{W}{m^2K},$$

where indicates the temperature (expressed by K°); indeed, the insulating elements themselves may reach λ [W/m K] 0.10-0.08 (and above), according to the different shapes, geometry and methods of assembling the elements themselves by means of special adequately shaped dovetails and grooves/slots.

Figure 1:
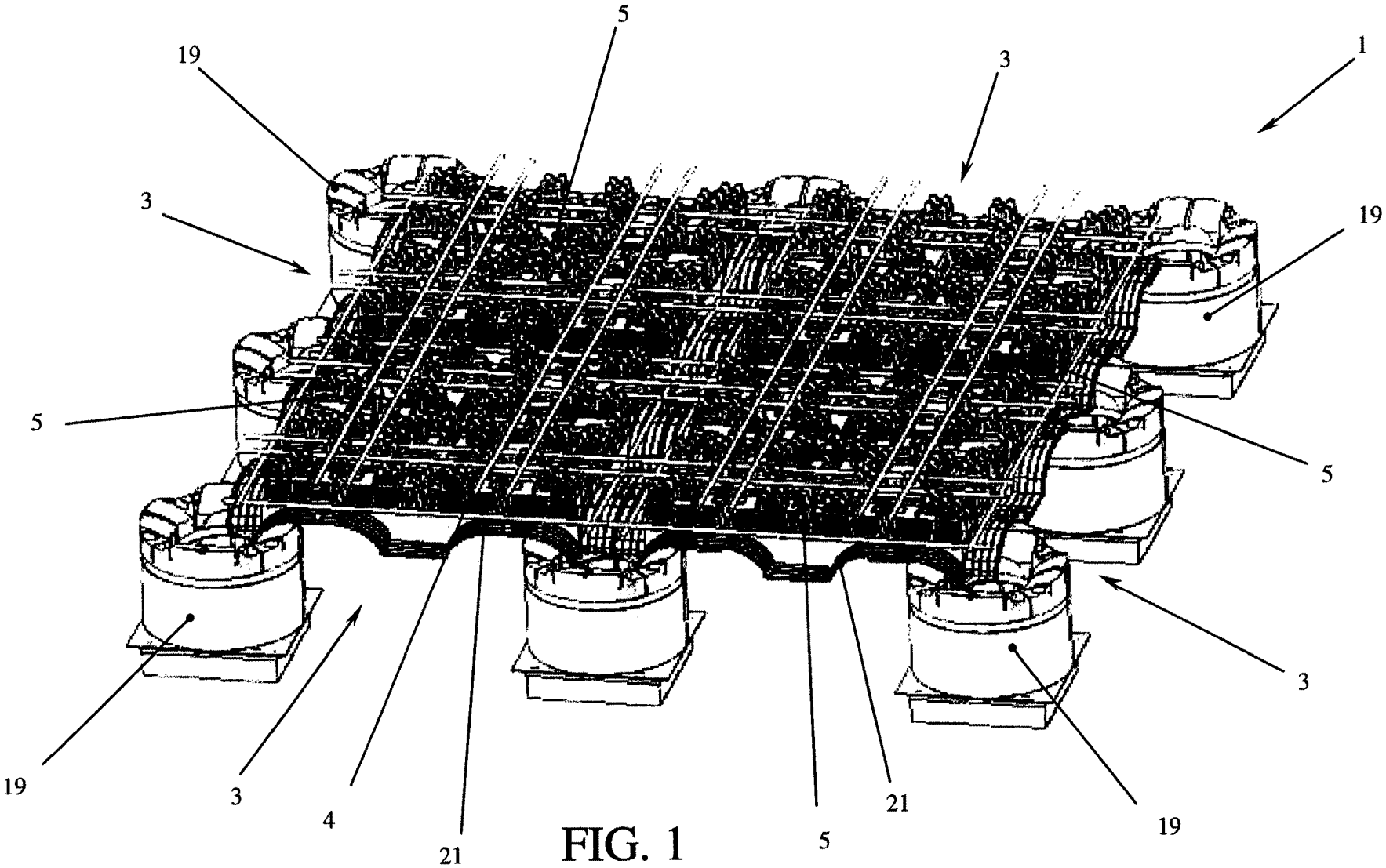
FIG. 1 shows a perspective top view of a preferred embodiment of a few elements making up the modular system in accordance with the present invention, in a possible assembling configuration.
Figure 2:
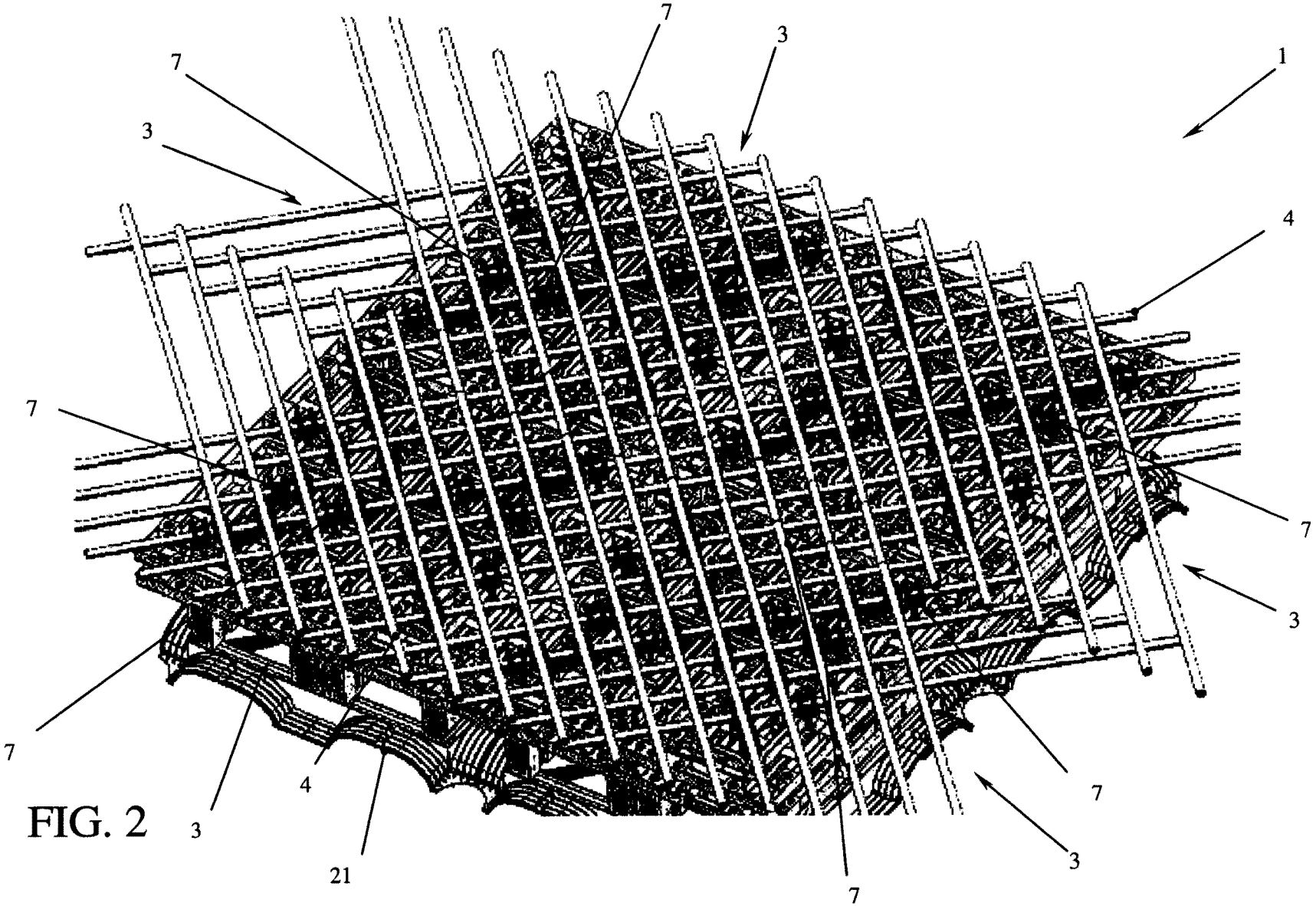
FIG. 2 shows another possible assembling configuration for the modular system illustrated in FIG. 1.
Figure 3:
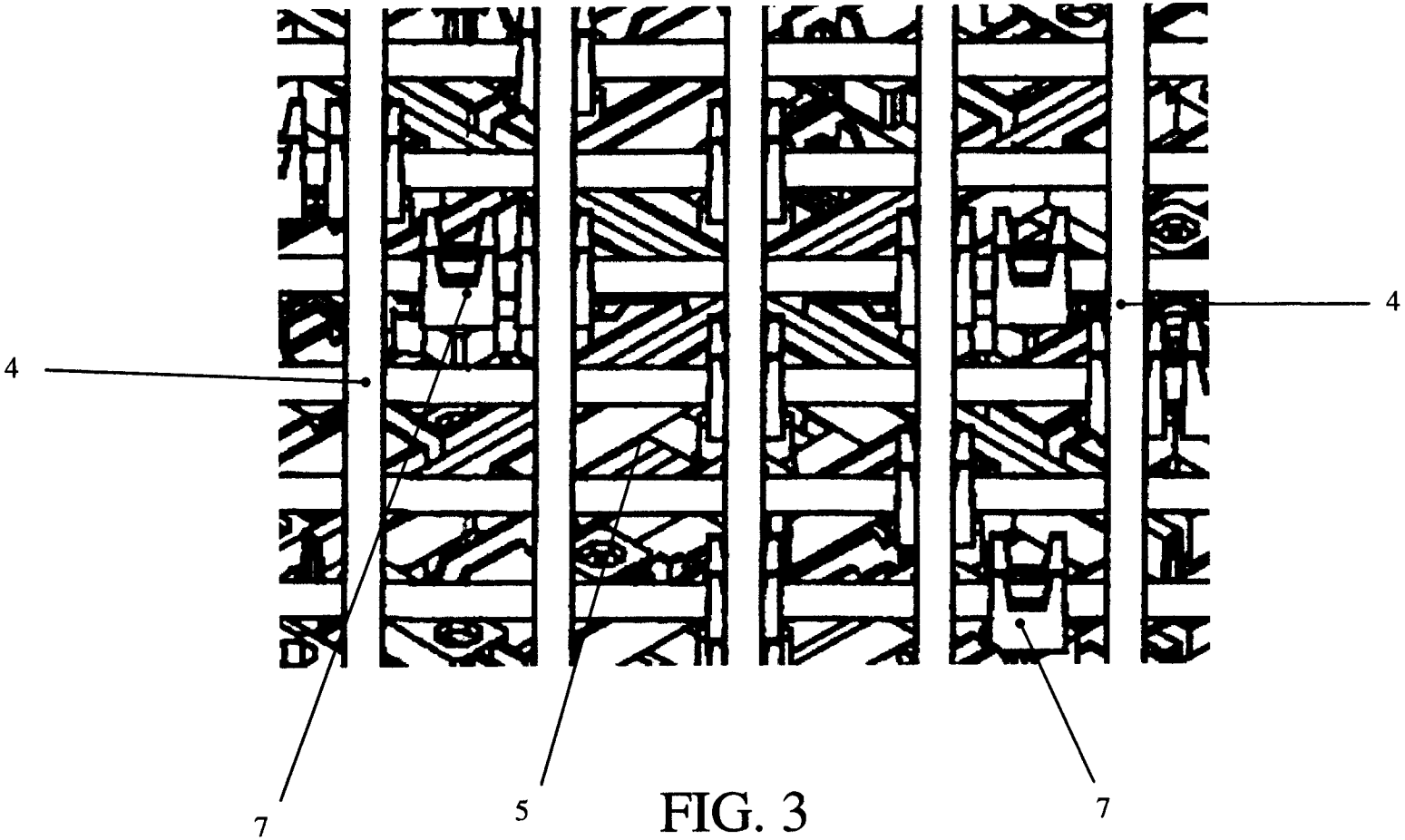
FIG. 3 shows an enlarged view of FIG. 2.

Thus, with reference to FIG. 1, in particular, you can notice that the system for assembling a transpiring, "disposable" heat-insulation shuttering mould/formwork 1 used for casting a reinforced concrete plane—and, in particular, for casting unidirectional, bi-directional, transpiring, ventilated and heat-insulation lofts, as well as monolith unidirectional and bi-directional, transpiring, ventilated and heat-insulation floors, and also unidirectional and bi-directional, transpiring, ventilated and heat-insulation slabs—includes at least one supporting plane 3 suited to allow the simple, easy and structural laying of tubular items, such as the rods 4 making up the reinforcement (usually made up of metal) without having to tie up the ordinary metal wires of said rods 4, as well as of any other tubular item such as, for instance, the water, gas or electricity piping: to this end, said supporting plane 3 incorporates an upper surface 5 on which a plurality of supports 7 have been properly arranged, each of said supports being suited to accommodate and retain (at least sideways inside itself) at least one longitudinal portion of any such tubular item. Obviously, the arrangement of said supports 7 on the upper surface 5 of said supporting plane 3 may be as varied as possible: productively, as detailed in FIG. 1, said supports 7 are arranged on said upper surface by very narrow pitches 5 in order to guarantee at least constrained support and the placing of the tubular items (such as rods 4) in mutually orthogonal positions. As an alternative (and/or in addition thereto), said supports 7 can be placed on said upper surface 5 also in order to guarantee support and positioning of tubular items (with a particular regard to rods 4) in mutually orthogonal and reticular positions.

Figure 9:
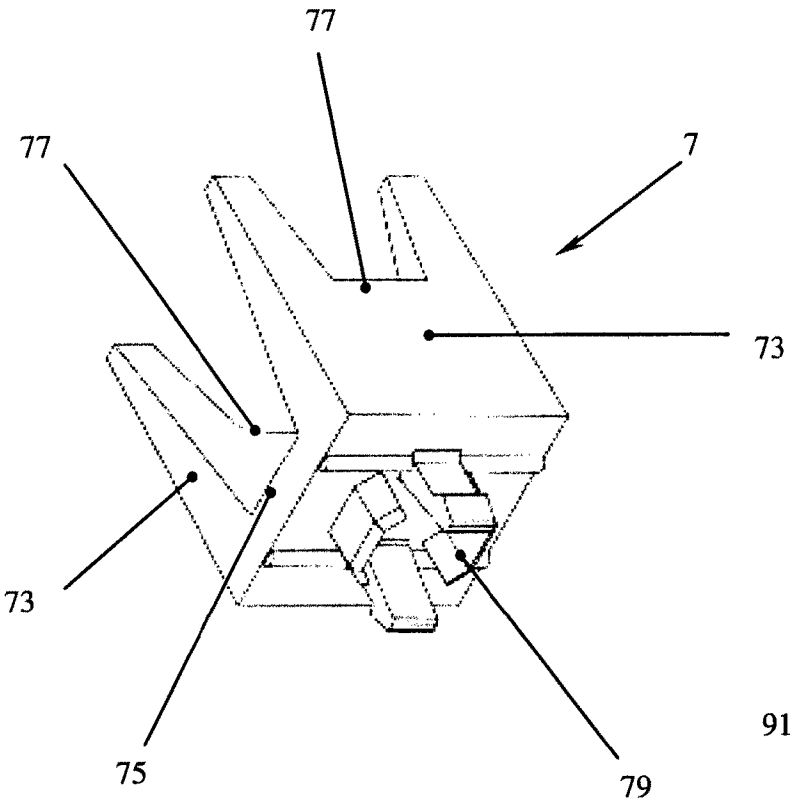
FIG. 9 shows a perspective top view of a preferred embodiment of another component part of the unique transpiring, heat-insulation modular system in accordance with the present invention.

With particular reference to FIG. 9, you can notice that each of said supports 7 is preferably made up of a supporting body 71 delimited by at least two side walls 73 defining each other, as well as of a base 75 of said supporting body 71 at least one first saddle suited to accommodate a portion of one first tubular item. Furthermore, each of said side walls 73 ends at the top with at least one profile shaped essentially like a 'U' (77) to define at least one second saddle suited to accommodate a portion of one second tubular item, arranged through cross-overlap (if necessary), with no reticular or rhomboid grading constraints, with the above-mentioned first tubular item (if any).

Figure 10:
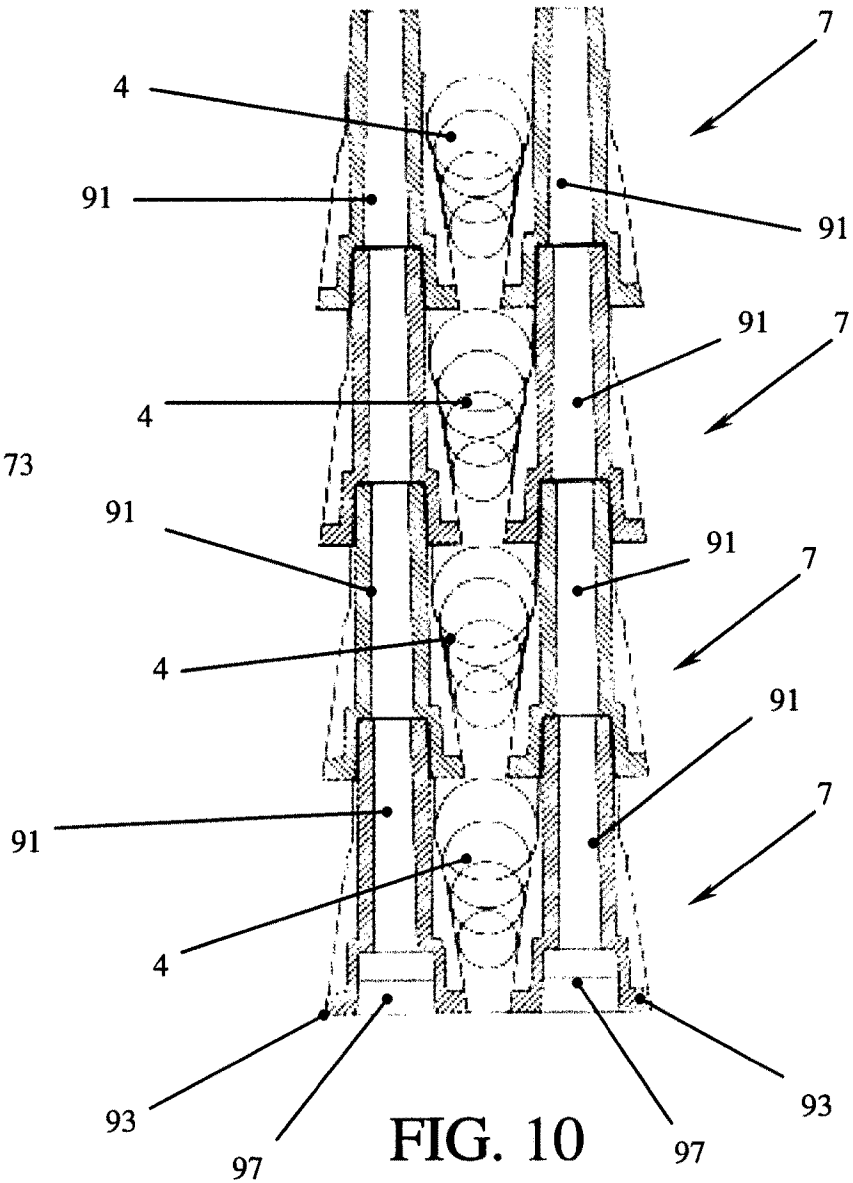
FIG. 10 shows a cross-section view of an alternative embodiment of the element shown in FIG. 9, according to one possible mode of utilization.

As an alternative—and by referring to FIG. 10, in particular—you can notice that each of said supports 7 is preferably made up of at least one pair of bodies 91 featuring at least a truncated-cone shape with the greater diameter corresponding to base 93: the peculiar truncated-cone shape of bodies 91 will productively make it possible to position the tubular items (and, above all, rods 4) at different heights depending on the diameter of the rods themselves. Such bodies 91 will also make it possible to alter the height at one's pleasure and in a modular fashion (thus guaranteeing a mandatory, homogeneous CLS bar cover, indeed as laid down by Eurocode 2—UNI EN 11104:2004) concerning the rod positions: in fact, in a possible mode of utilization not described herein, at least two bodies can be stacked by placing a tray in between, such tray being suited to contain and support the base of the body placed at the top, or, in case said bodies 91 incorporate a suitable hollow 97 able to match, at least in part, with the outer shape of any such body 91, they can be merely stacked onto one another (see FIG. 10) so that the rod positioning height can be determinate to a higher degree of accuracy.

In addition, it can be anticipated that supports 7 will be connected with one another by means of transpiration ducts, so as to facilitate the transpiration process inside the transpiring, "disposable" heat-insulation shuttering mould/formwork.

Furthermore, it can be productively anticipated that each of said supports 7 can be positioned freely onto the upper surface 5 of supporting plane 3, so that more possible rod laying configuration modes will be available and able to be adapted to specific requirements, in order to obtain metal reinforcements of varied forms so as to comply with all of the laws and regulations in force in the building and construction trade. To this end, base 75 (or each of bases 93 of support 7) can be equipped with at least one hooking profile 79, for instance by means of elastic-strain opposed teeth, suited to engage a respective corresponding seat 9 made available on the upper surface 5 of supporting plane 3, such seat 9 belonging to a plurality of similar seats arranged in various manners on all of such surface 5, as shown by way of example in FIG. 4. It is most obvious that the supports 7 themselves can be secured to the upper surface 5 of supporting plane 3 in the most appropriate positions to obtain the several textures of the desired metal reinforcement by means of any other items technically suited to the purpose, such as, for instance, screws, bolts or gluing.

In addition, as regards one further variant that has not been illustrated, such body can also be equipped, next to one of its upper vertexes, with at least one seat suited to accommodate a respective hooking profile 79 placed on the base of another body, in order to stabilize and make the multiple stacking thereof integral, with no limitations at all.

Figure 4:
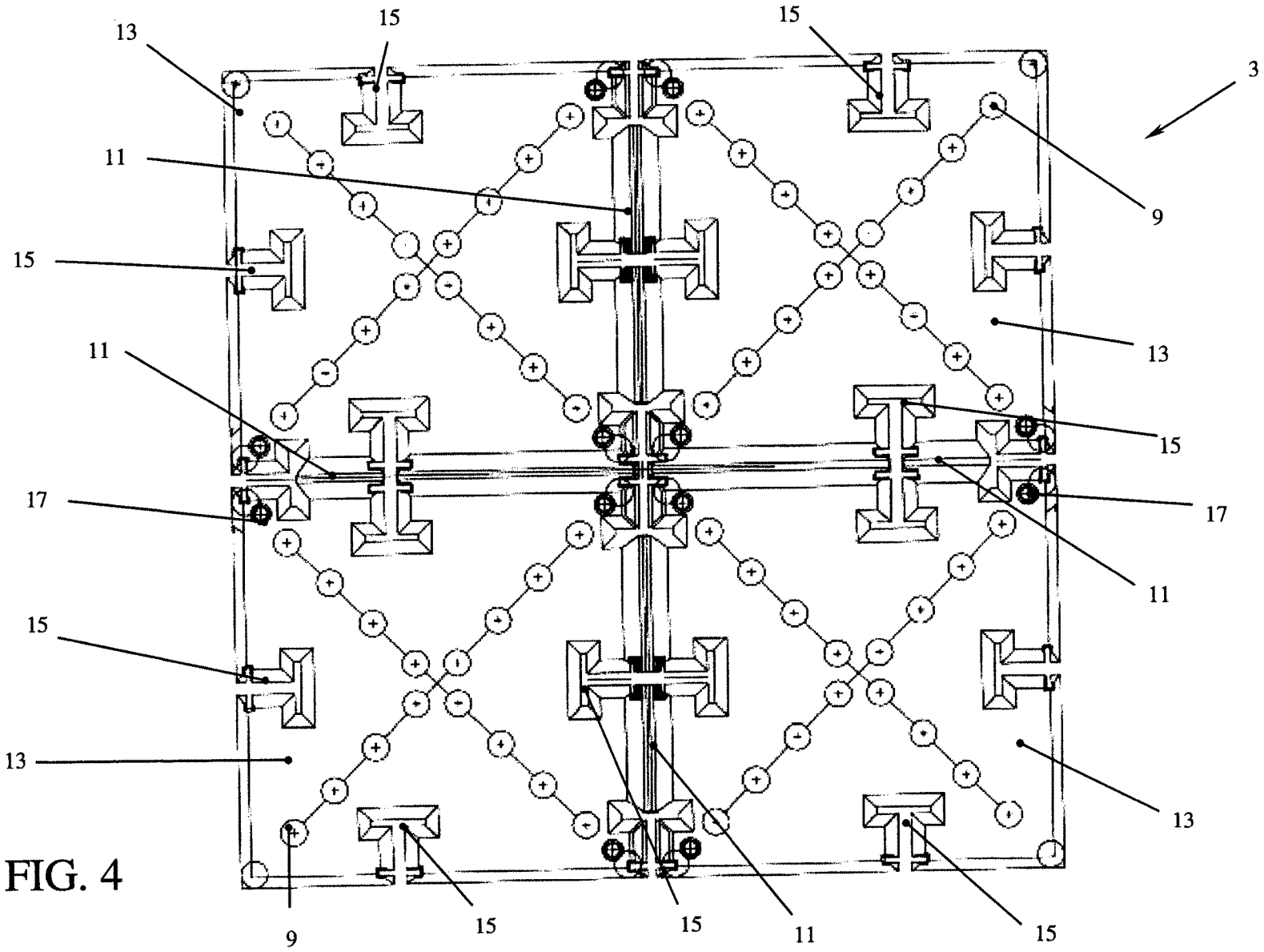
FIG. 4 shows a plan view of an alternative embodiment of an element making up the modular system in accordance with the present invention of FIG. 1.

By referring, now—and in particular—to FIG. 4, you can notice that a supporting plane 3 of the transpiring heat-insulation construction system referred to in the present invention also features score lines 11 suited to allow modular partitioning of the same supporting plane 3 into supporting planes featuring smaller dimensions and different shapes from the ones of the originally intact supporting plane 3.

The supporting plane 3 shall preferably feature two such score lines 11 arranged in a mutually perpendicular position, so that they will divide the surface of supporting plane 3 into four partitions 13 having equal dimensions.

Still with reference to FIG. 4, you can notice that the supporting plane 3 features, on its own perimeter, lock-in profiles 15 suited to accommodate the corresponding connection profile for any one spacing connector of the type peculiar to said construction system, as well as the ones known in the relevant engineering field in order to allow structural connection of supporting plane 3 with at least another supporting plane 3 and/or other modular elements of the transpiring heat-insulation construction system referred to in this invention, which will be described hereafter. In addition, as you can notice in FIG. 4, it can be anticipated that every single partition 13 of supporting plane 3 will also feature, on its perimeter, lock-in profiles 15, so that even one single partition 13 can be productively connected by means of one or several spacing connectors 16 with another supporting plane 3 and/or another partition 13 and/or the other modular elements of the unique transpiring heat-insulation modular construction system referred to in the present invention hereafter.

In order to guarantee the necessary, proper transpiration inside the transpiring, "disposable" heat-insulation shuttering mould/formwork 1, the surface of supporting plane 3 may feature a plurality of such through holes 17 and/or transpiration channels (not shown) that they will guarantee the creation of a real smooth transpiration grid, so as not to constrain the outflow of condensate and/or vapour inside the transpiring, "disposable" heat-insulation formwork 1 itself.

In order to guarantee the necessary heat insulation from the ground, the soil (cf. DE Passivhaus standard) or any other bearing surface, the supporting plane 3 can be made of any one plastic material, such as, for instance, polypropylene or polystyrene, suitable to the purpose. Furthermore, in order to make it possible to build a transpiring, ventilated and heat-insulation French drain (as shown, by way of example, in FIG. 1), the supporting plane 3 may be supported by modular, heat-insulation spacing elements 19 resting on the ground by placing a supporting frame 21, if necessary, in between. To this end, the supporting plane 3 may feature a lower surface adequately adapted and shaped to stick and fit into a corresponding upper profile of the supporting frame 21, so that the overlap of the same will be simple and fully constrained, immediate and stable, without making use of any further fastening means to prevent reciprocal movements when the additional concrete is cast to obtain a surface. In addition, the lower surface of supporting plane 3 may be adapted and shaped to correspond with the profile of upper surface 5: thus, several supporting planes 3 (or several partitions 13) can be easily and firmly overlapped in a highly modular fashion, for instance in order to enhance the heat insulation from the ground and comply exclusively with the strictest standards, such as the DE Passivhaus protocol (i.e. passive houses with zero energy consumption).

Figure 5:
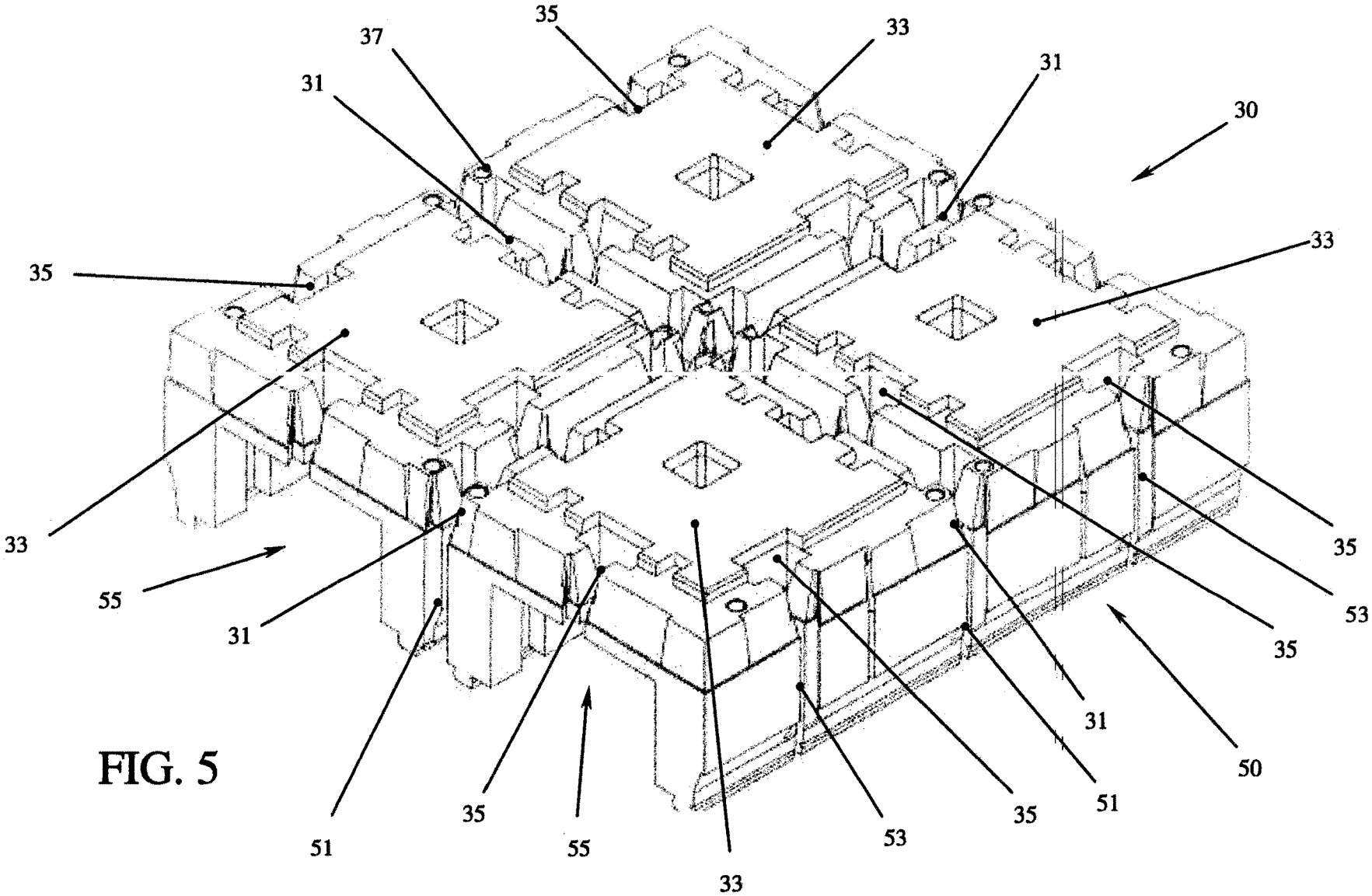
FIG. 5 shows a perspective top view of a preferred embodiment of another transpiring heat-insulation component part of the modular system in accordance with the present invention.

By referring, instead, to FIG. 5 in particular, you can notice that the system for assembling a "disposable" shuttering mould/formwork 1 used for casting a concrete plane and, in particular, for casting unidirectional, bi-directional, transpiring, ventilated and heat-insulation lofts, as well as monolith unidirectional and bi-directional, transpiring, ventilated and heat-insulation floors, and also unidirectional and bi-directional, transpiring, ventilated and heat-insulation slabs, also includes at least one heat-insulation hollow floor brick 30 featuring score lines 31 suited to allow modular partitioning of the same heat-insulation hollow floor brick into heat-insulation hollow floor bricks featuring smaller dimensions and different shapes from the ones of heat-insulation hollow floor brick 30 originally built as an intact piece by stamping or hot wire cutting. The heat-insulation hollow floor brick 30 should preferably feature two such score lines 31 arranged in a mutually perpendicular position, so that they will divide the surface of the heat-insulation hollow floor brick into four partitions 33 featuring the same dimensions to one another. Furthermore, the heat-insulation hollow floor brick 30 features, on its perimeter, lock-in profiles 35 suited to accommodate the corresponding connection profile for any one spacing connection peculiar to said system 16, also of the type known in the relevant engineering field, in order to allow structural connection of the heat-insulation hollow floor brick 30 with at least another heat-insulation hollow floor brick and/or at least one supporting plane 3 and/or at least one partition 13 thereof. In addition, it can be anticipated that every single partition 33 of heat-insulation hollow floor brick 30 will feature, on its perimeter, the lock-in profiles 35 so that even one single partition 33 can be productively connected by means of one or several spacing connectors 16 with at least one supporting plane 3 and/or at least another partition 13, 33 and/or at least another heat-insulation hollow floor brick 30.

Furthermore, the heat-insulation hollow floor brick 30 may feature a lower surface adequately adapted and shaped to stick and fit into the corresponding upper profile of the supporting frame 21, so that the overlap of at least one (or several) of them will be simple, immediate and stable, without making use of any further fastening means to prevent reciprocal movements when the additional structural concrete is cast. Moreover, the upper surface of the heat-insulation hollow floor brick 30 may be adapted and shaped to correspond with the profile of the lower surface of supporting plane 3, so that a heat-insulation hollow floor brick 30 and a supporting plane 3 (or their partitions 13, 33) can be overlapped easily and firmly, for instance in order to enhance the insulation from the ground or make thermal transmittance passive. In order to guarantee the necessary, proper transpiration inside the transpiring, "disposable" heat-insulation shuttering mould/formwork 1, the surface of heat-insulation hollow floor brick 30 may feature a plurality of such through holes 37 and/or transpiration channels that they will guarantee the creation of a real transpiration grid inside the transpiring, "disposable" heat-insulation shuttering mould/formwork 1 itself. Such through holes 37 and/or transpiration channels shall preferably match with the similar holes and/or channels found on supporting plane 3, so that, in case of overlap between a supporting plane 3 and a heat-insulation hollow floor brick 30 (or between their partitions 13, 33), the availability of the transpiration grid inside the transpiring, "disposable" heat-insulation shuttering mould/formwork 1 will be ensured.

Please note that the heat-insulation hollow floor brick 30 can be used to build a loft and can also be hooked integrally to the thermo-acoustic panel placed vertically to form the loft or roof soffit, or resting directly onto the ground itself. The heat-insulation hollow floor brick 30 itself can be considered as an element to form a ventilated, integral thermal insulation coating (free from thermal bridges) and can be integrally hooked, in a "lock-in" fashion, to special profiles (not shown) made of steel or aluminum alloys or structural extruded profiles made of fibre glass (G.F.R.P.) or structural composite thermoplastic materials. The same profiles are integrally blocked, by means of dowels, into an existing wall made also of conventional materials.

Figure 6:
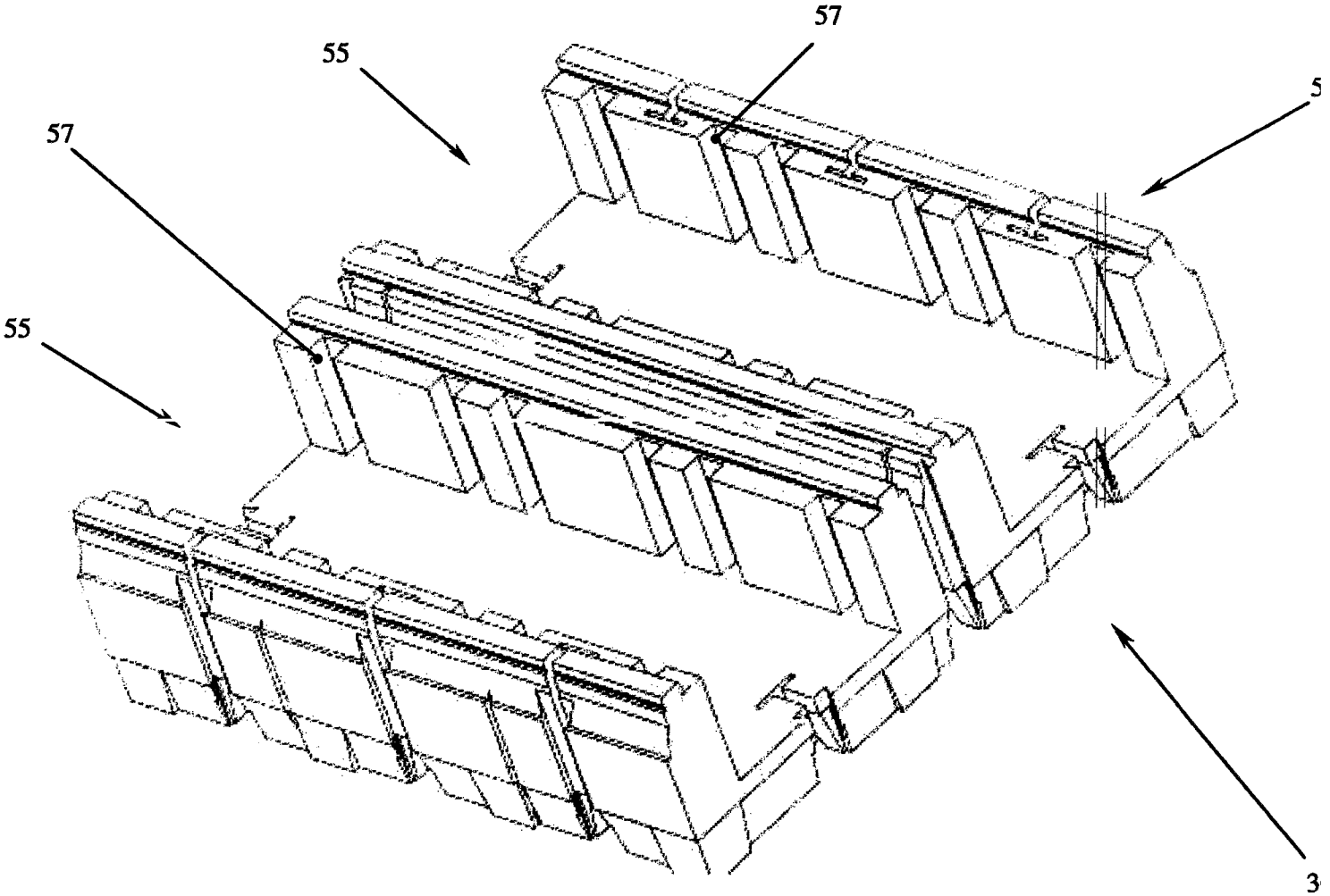
FIG. 6 shows a perspective bottom view of the transpiring, heat-insulation element featuring slots and/or grooves and scores, shown in FIG. 5.

By referring, in particular, to FIGS. 5 and 6, you can notice that the system for assembling a transpiring, "disposable" heat-insulation shuttering mould and/or formwork 1 used for casting a concrete plane and, in particular, for casting unidirectional, bi-directional, transpiring, ventilated and heat-insulation lofts, as well as monolith unidirectional and bi-directional, transpiring, ventilated and heat-insulation floors, and also unidirectional and bi-directional, transpiring, ventilated and heat-insulation slabs, includes at least an insulating base 50 featuring an upper surface adapted and shaped to match with the profile of the lower surface of supporting plane 3 and of heat-insulation hollow floor brick 30, so that a heat-insulation hollow floor brick 30 and/or a supporting plane 3 (or their partitions 13, 33) can be overlapped easily and firmly, for instance in order to enhance the insulation from the ground against rising moisture, to the insulating base 50 itself. At the same time, the insulating base 50 may also feature a lower surface suitably adapted and shaped to stick and fit into the corresponding upper profile of supporting frame 21, so that the overlap of the same will be simple, immediate and stable, without making use of any further fastening means to prevent reciprocal movements when the additional concrete is cast to obtain a structural surface.

The heat-insulation base 50 can also be equipped, on its perimeter, with lock-in profiles suited to accommodate the corresponding connection profile for any one spacing connector 16 of the type known in the relevant engineering field in order to allow perfect structural connection of heat-insulation base 50 with at least another heat-insulation hollow floor brick and/or at least one supporting plane 3 and/or at least one partition 13, 33 of the latter and/or another heat-insulation base 50: the lock-in profiles 53 will productively correspond with the lock-in profiles 15, 35 of a respective supporting plane 3 or heat-insulation hollow floor brick 30 when overlapping such heat-insulation base 50.

Furthermore, the heat-insulation base 50 may feature score lines 51 suited to allow modular partitioning of the same heat-insulation base 50 into bases featuring smaller dimensions and different shapes from the ones of the originally intact base 50, such dimensions and shapes being essentially the same as the ones of the above-mentioned partitions 13, 33. Similarly, in order to guarantee the full, unique modular design of the construction system of transpiring, "disposable" heat-insulation shuttering moulds and/or formworks referred to in the present invention, every single partition of the heat-insulation base 50 may feature, on its perimeter, lock-in profiles 53 so that these profiles will productively correspond with lock-in profiles 15, 35 even of individual partitions 13, 33 in case they are stacked on such partition of the heat-insulation base 50.

Each heat-insulation base 50 shall preferably feature such a section as a form essentially shaped like a "U" upside down, which defines an insulating channel 55. Grooves 57 shall preferably be found along the side walls of said insulating channel 55, which are suited to make it possible to insert insulating partitions (not shown) at varying distances, which are suited to prevent, if necessary, the penetration of concrete into the channel/hollow 55 at the time of casting the structural concrete and also enhance the insulation provided by the insulating base without the formation of convective air motions 50.

Here too, in order to guarantee the necessary heat insulation from the ground, the soil or any other bearing surface, both the heat-insulation hollow floor brick 30 and the insulating base 50 can be made of any one plastic material such as, for instance, polystyrene, and other materials featuring unique insulating and sound-proofing characteristics, as commensurate to the purpose.

Furthermore, the heat-insulation hollow floor brick 30 and, if necessary, the insulating base 50, may be made by means of vacuum techniques, in order for the same to feature top thermal and acoustic characteristics.

Figure 7:
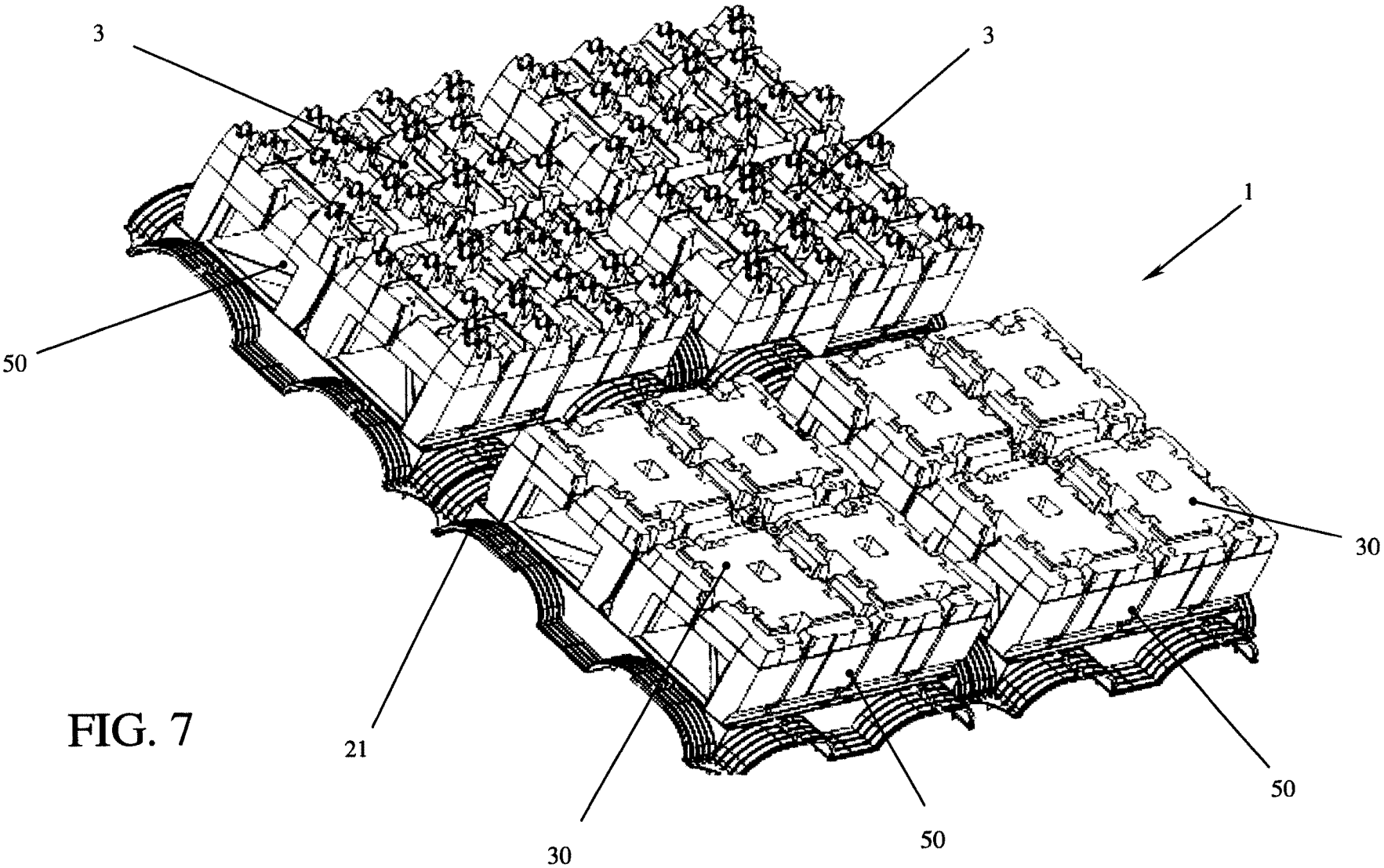
FIG. 7 shows a perspective top view relative to a preferred embodiment of a few component parts of the transpiring, heat-insulation modular system in accordance with the present invention, in another possible assembling configuration.

By referring, in particular, to FIG. 7, you can notice that, as regards the making of the transpiring, "disposable" heat-insulation shuttering mould and/or formwork 1 by applying the modular construction system referred to in the present invention, several different elements can be combined in various ways, such as, for instance, two supporting planes 3 and two heat-insulation hollow floor bricks 30 supported by supporting frames 21 by placing the respective insulating bases 50 in between.

Figure 8:
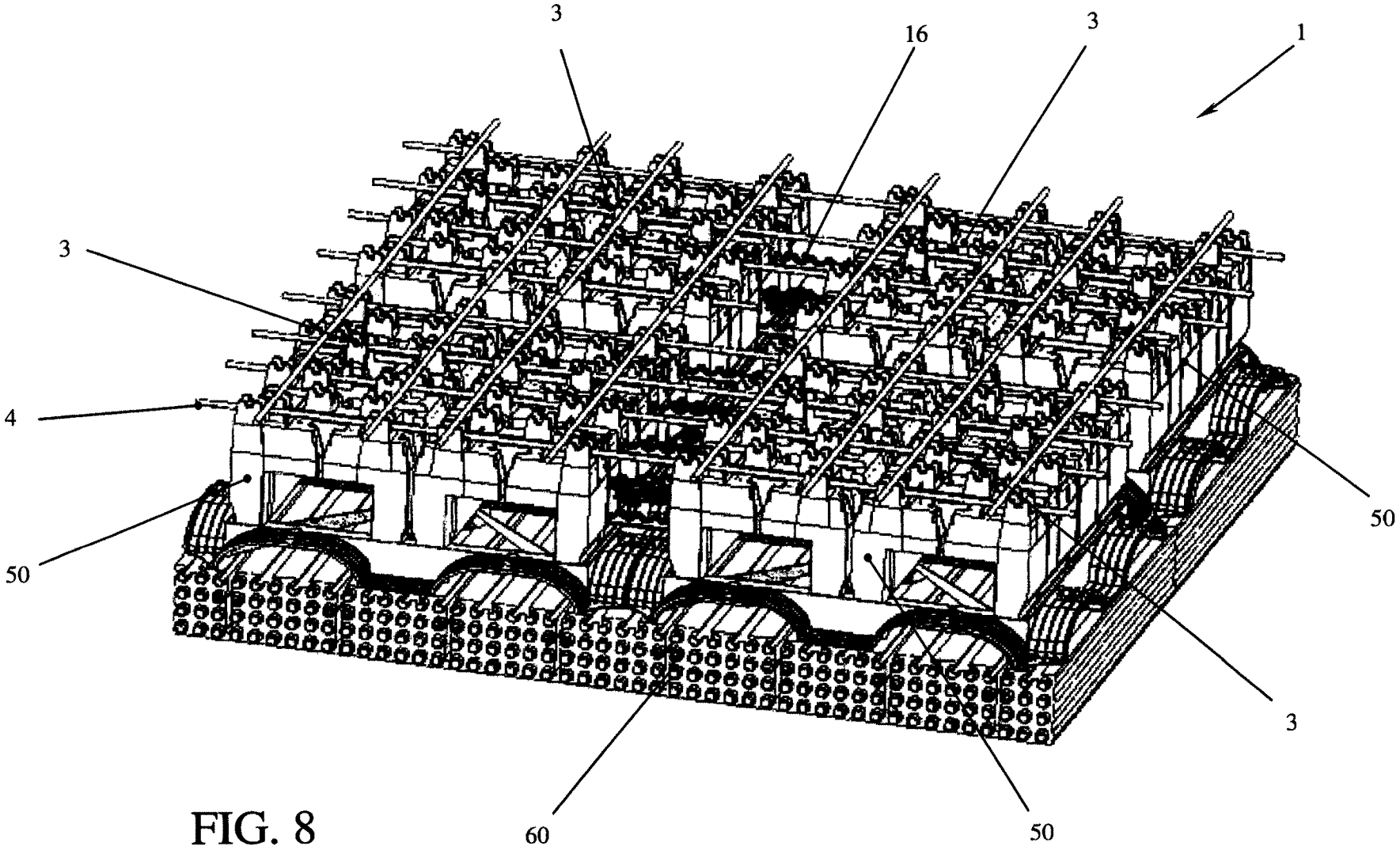
FIG. 8 shows a perspective top view of a preferred embodiment of a few component parts of the transpiring, heat-insulation modular system in accordance with the present invention, in one further possible assembling configuration.

By referring, instead, to FIG. 8, you can notice another possible and exemplifying embodiment of the transpiring, "disposable" heat-insulation shuttering mould and/or formwork 1 by applying the modular construction system referred to in the present invention, in which four supporting planes 3 are connected (i.e. three of them) by means of spacing connectors 16 and supported by supporting frames 21 by placing the respective insulating bases 50 in between, such supporting frame 21 being also connected to a base frame 60 typically of the high-density polystyrene foam type.

Figure 11:
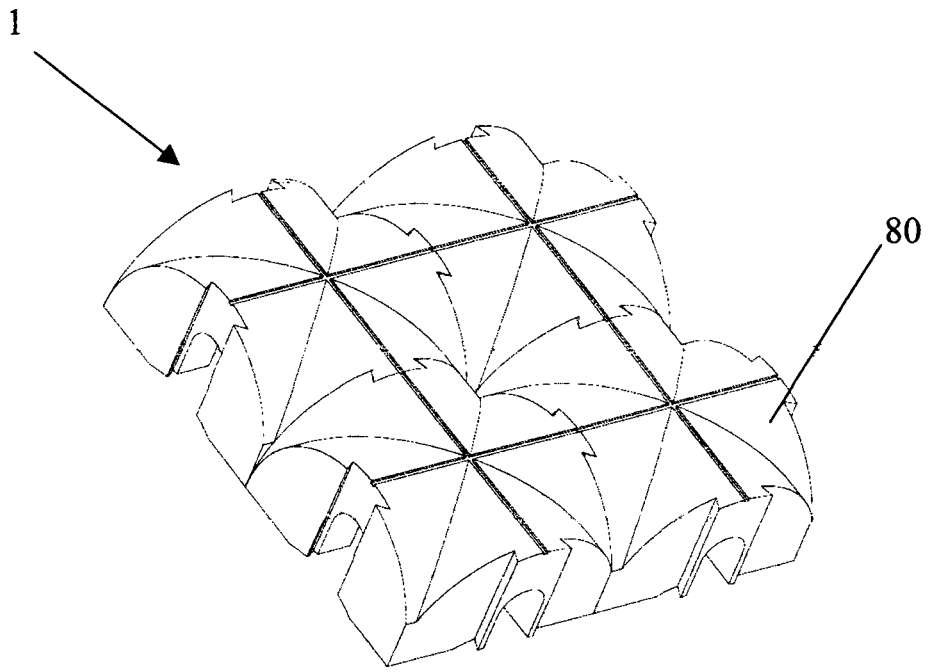
FIGS. 11 to 16 show other variants of the heat-insulation modular system relative to the invention, according to the so-called "igloo" configuration, with provisions for building a dual ventilation chamber.
Figure 12:
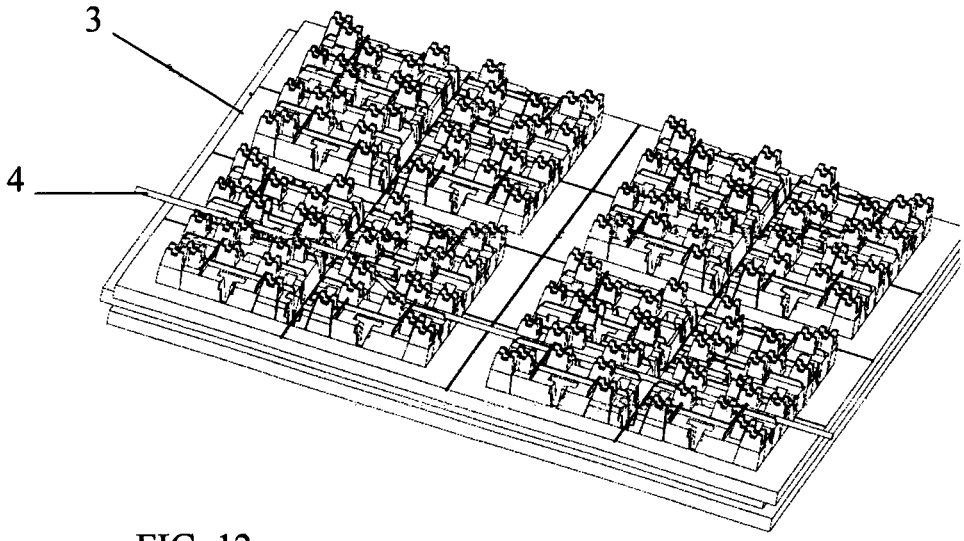
Figure 13:
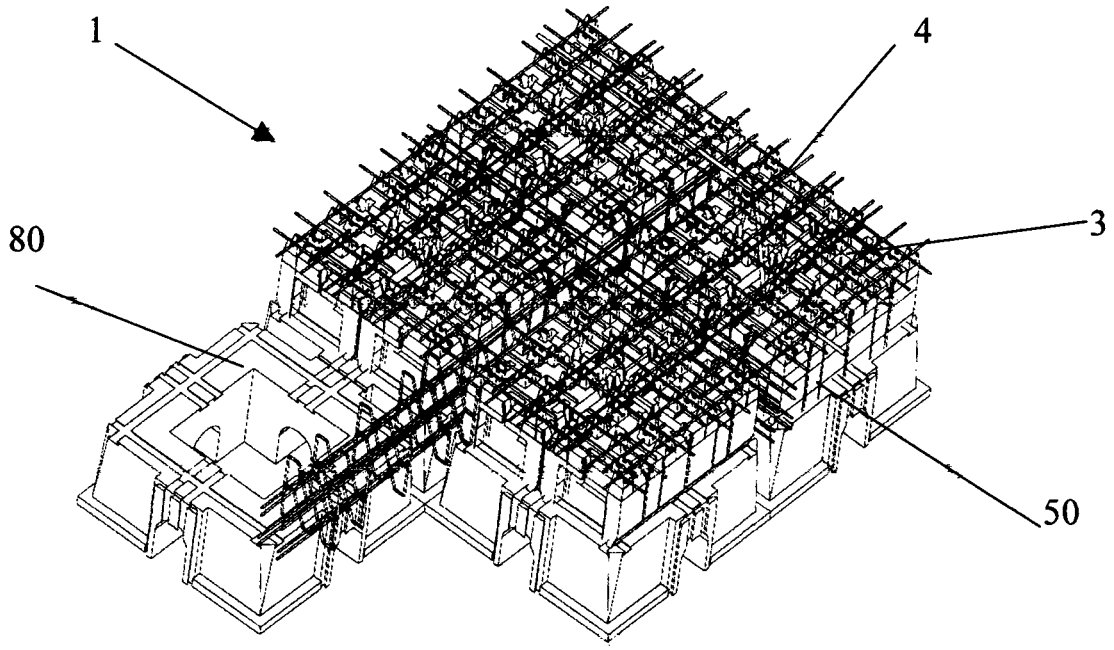
Figure 14:
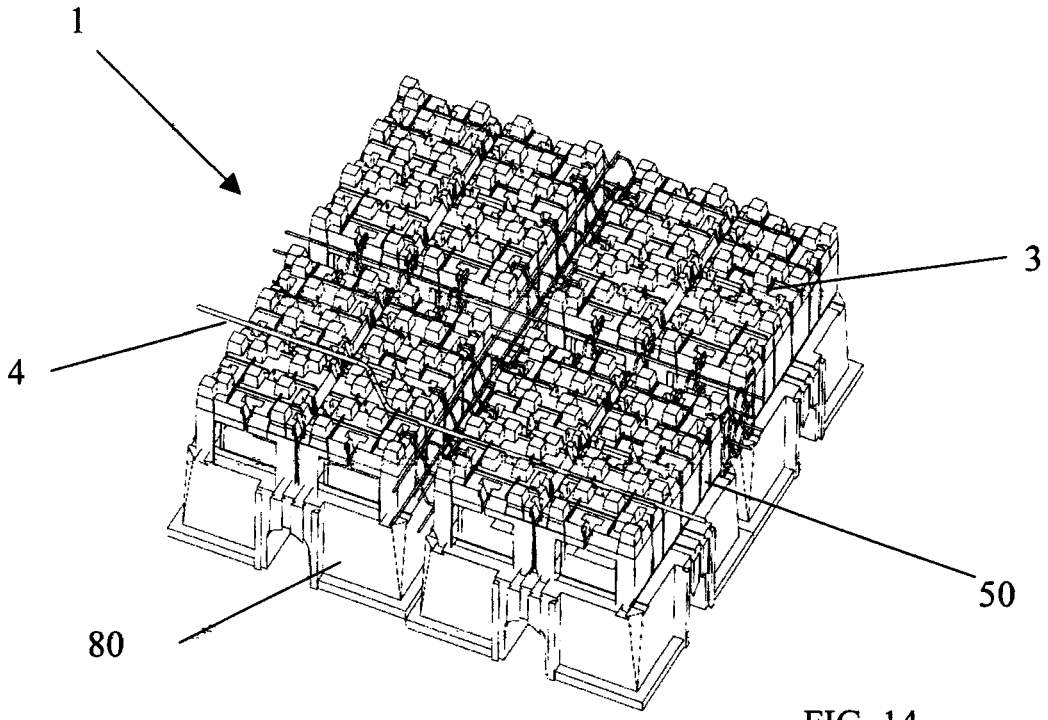
Figure 15:
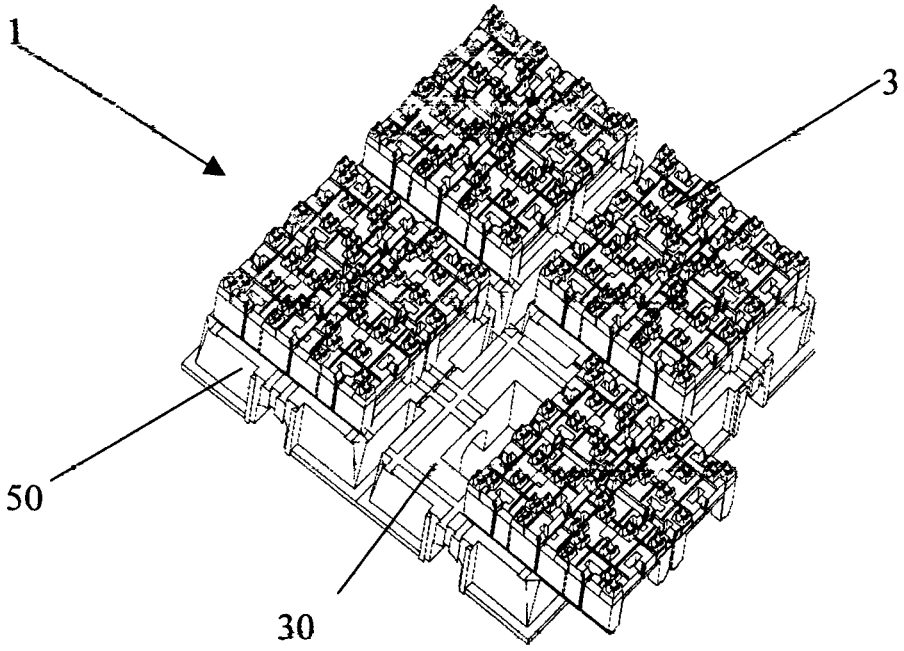
Figure 16:
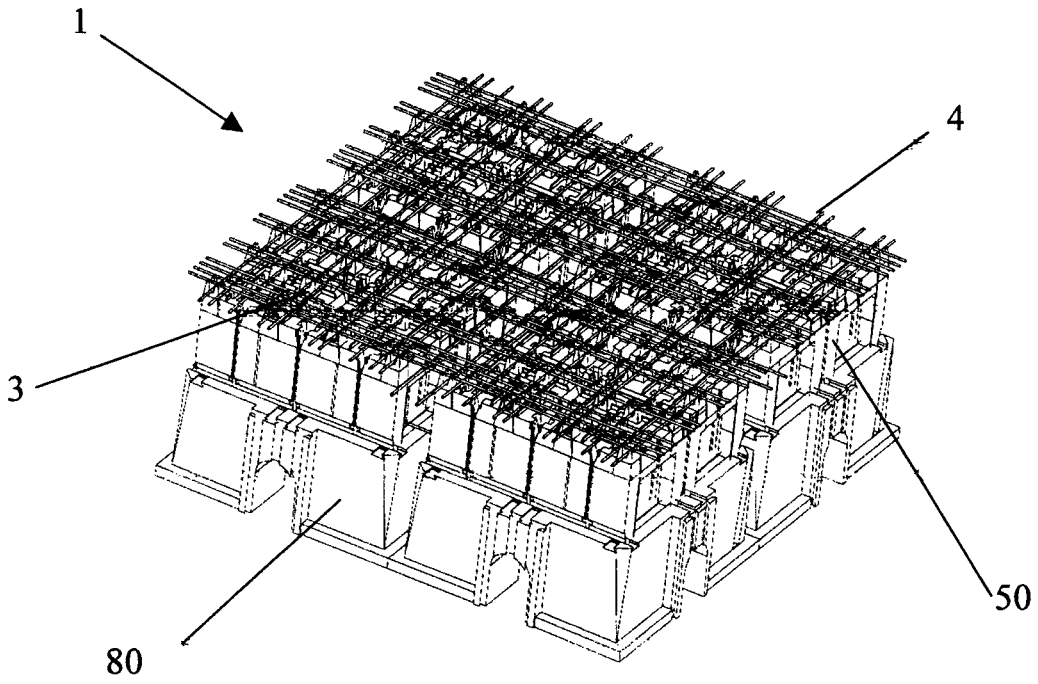

FIGS. 11 to 16 show other variants of the modular construction system 1 relative to the invention, according to the so-called "igloo" configuration 80, featuring a dual ventilation chamber, as shown in details in FIGS. 11-13.

Obviously, all of the elements described above (or some of them) relative to the modular construction system referred to in the present invention can be used both in conventional building works and, above all, in the sustainable environment-friendly building works, both to build, from the very beginning, unidirectional, bi-directional, transpiring, ventilated and heat-insulation lofts, as well as monolith unidirectional and bi-directional, transpiring, ventilated and heat-insulation floors, and also unidirectional and bi-directional, transpiring, ventilated and heat-insulation slabs, and also refurbish crumbling floors, lofts and slabs previously existing and not complying with the anti-seismic and thermo-acoustic requirements, and also build, for instance, micro-ventilated and macro-ventilated roofs, with provisions for being fitted to any one type of new or existing outer curve (though a crumbling one) failing to meet any one requirement referred to several times, that is to say, even a wooden one, with no applicability constraints.

The invention claimed is:

1. A system for assembling a transpiring, disposable heat-insulation shuttering mould and/or formwork used for casting a concrete surface and, in particular, for casting unidirectional, bi-directional, transpiring, ventilated and heat-insulation lofts, as well as monolith unidirectional and bidirectional, transpiring, ventilated and heat-insulation floors, and also unidirectional and bi-directional, transpiring, ventilated and heat-insulation slabs, said system including at least one supporting plane featuring one upper surface on which a plurality of supports have been arranged, each support of said plurality of supports being suited to accommodate and retain at least one longitudinal or reticular portion of a tubular item, wherein said support is made up of a supporting body delimited by at least two side walls defining, between themselves and one base of said supporting body, at least one first saddle suited to accommodate one portion of a first rod, each of said side walls ending, at the top, with at least one profile featuring a form essentially shaped like a 'U' to define at least one second saddle suited to accommodate one portion of a second rod, said base being fitted with at least one hooking profile suited to engage a respective and corresponding seat available on said upper surface of said supporting plane, said corresponding seat belonging to a plurality of similar seats arranged on the entire surface mentioned above in various ways, wherein said supporting plane comprises lock-in profiles situated on its perimeter to accommodate a corresponding connection profile for a spacing connector.

2. The system in accordance with claim 1, wherein said tubular element is a making up a reinforcement for said transpiring, disposable heat-insulation shuttering mould and/or formwork.

3. The system in accordance with claim 1, wherein said tubular element is a water, electricity or gas conveying duct.

4. The system in accordance with claim 1, wherein said supports are arranged on said upper surface to provide constrained support for said first rod and/or said second rod in mutually orthogonal and reticular positions.

5. The system in accordance with claim 1, wherein said supports are arranged on said upper surface to provide constrained support for said first rod and/or said second rod in mutually diagonal positions.

6. The system in accordance with claim 1, wherein said support is made up of at least one pair of bodies shaped at least like a truncated cone and with a larger diameter next to one base.

7. The, system in accordance with claim 6, wherein said bodies can be stacked by placing at least one tray in between.

8. The system in accordance with claim 7, wherein said body incorporates a hollow suited to match, at least in part, with an outer shape of said body.

9. The system in accordance with claim 1, wherein said body features, next to an upper vertex of its own, at least one seat suited to accommodate one said respective hooking profile.

10. The system in accordance with claim 1, wherein said supporting plane features score lines suited to allow modular partitioning of said supporting plane itself into supporting planes featuring smaller dimensions and different shapes from the ones relative to said originally intact supporting plane.

11. The system in accordance with claim 10, wherein said score lines are two and are arranged in a mutually perpendicular position so as to divide a surface of said supporting plane into four said partitions having the same dimensions.

12. The system in accordance with claim 10, wherein said modular partitioning comprises, on its perimeter, lock-in profiles suited to accommodate a corresponding connection profile for a spacing connector.

13. The system in accordance with claim 1, wherein one surface of said supporting plane features a plurality of through holes and/or transpiration channels.

14. The system in accordance with claim 1, wherein said supporting plane features a lower surface adapted and shaped to stick and fit into a corresponding upper profile of a supporting frame.

15. The system in accordance with claim 14, wherein said lower surface is adapted and shaped to correspond with a profile of said upper surface.

16. The system in accordance with claim 1 wherein said system includes at least one heat-insulation hollow floor brick featuring score lines suited to allow modular partitioning of said heat-insulation hollow floor brick itself into hollow floor bricks featuring smaller dimensions and different shapes from the ones of said originally intact heat-insulation hollow floor brick.

17. The system in accordance with claim 16, wherein said score lines are two and are arranged in a mutually perpendicular position so as to divide a surface of said hollow floor brick into four said partitions having the same dimensions.

18. The system in accordance with claim 16, wherein said hollow floor brick features lock-in profiles suited to accommodate a corresponding connection profile for a spacing connector.

19. The system in accordance with claim 16, wherein said modular partitioning comprises, on its perimeter, lock-in profiles suited to accommodate a corresponding connection profile for a spacing connector.

20. The system in accordance with claim 16, wherein said heat-insulation hollow floor brick features a lower surface adapted and shaped to stick and fit into a corresponding upper profile of said supporting frame.

21. The system in accordance with claim 16, wherein one upper surface of said heat-insulation hollow floor brick or of said modular partitioning is adapted and shaped to correspond with a profile of said lower surface of said supporting plane or of said partition.

22. The system in accordance with claim 16, wherein a surface of said heat-insulation hollow floor brick features a plurality of through holes and/or transpiration channels, which shall preferably correspond with said holes and/or channels of said supporting plane.

23. The system in accordance with claim 16, wherein it includes at least an insulating base featuring an upper surface adapted and shaped to correspond with a profile of said lower surface of said supporting plane and of said heat-insulation hollow floor brick.

24. The system in accordance with claim 23, wherein said insulating base features a lower surface adapted and shaped to stick and fit into a corresponding upper profile of said supporting frame.

25. The system in accordance with claim 23, wherein said insulating base features lock-in profiles suited to accommodate a corresponding connection profile for a spacing connector, said lock-in profiles corresponding with said lock-in profiles of a respective said supporting plane or said hollow floor brick, when overlapping said insulating base.

26. The system in accordance with claim 23, wherein said insulating base features score lines suited to allow modular partitioning of said insulating base itself into bases featuring smaller dimensions and different shapes from the ones of said originally intact base, said dimensions and shapes being essentially equal to the ones of said partitions.

27. The system in accordance with claim 26, wherein a partition of a heat-insulation base into a plurality of partition features, on its perimeter, lock-in profiles corresponding with said lock-in profiles of said plurality of partitions.

28. The system in accordance with claim 23, wherein said insulating base feature such a section as a form essentially shaped like a "U" upside down, which defines an insulating channel.

29. The system in accordance with claim 28, wherein grooves, suited to allow insulating partitions to be inserted at varying distances, are available along side walls of said insulating channel.

30. The system in accordance with claim 23, wherein said heat-insulation hollow floor brick and/or said insulating base are obtained by means of vacuum processing, stamping operations and hot wire cutting operations by means of hand punches adequately shaped to create hollows, dovetails and tapers.

* * * * *